US008453738B2

(12) United States Patent
Martinez

(10) Patent No.: US 8,453,738 B2
(45) Date of Patent: Jun. 4, 2013

(54) METHODS AND SYSTEMS FOR DOWNHOLE ACTIVE COOLING

(75) Inventor: Alejandro Martinez, Calgary (CA)

(73) Assignee: Schlumberger Technology Corporation, Sugar Land, TX (US)

( * ) Notice: Subject to any disclaimer, the term of this patent is extended or adjusted under 35 U.S.C. 154(b) by 397 days.

(21) Appl. No.: 12/652,722

(22) Filed: Jan. 5, 2010

(65) Prior Publication Data

US 2011/0162847 A1 Jul. 7, 2011

(51) Int. Cl.
*E21B 36/00* (2006.01)

(52) U.S. Cl.
USPC ..... 166/302; 166/305.1

(58) Field of Classification Search
USPC ..... 166/305.1, 302
See application file for complete search history.

(56) References Cited

U.S. PATENT DOCUMENTS

2003/0075361 A1* 4/2003 Terry et al. ..... 175/61
2003/0085039 A1* 5/2003 DiFoggio ..... 166/302
2007/0012483 A1* 1/2007 Self et al. ..... 175/45
2007/0114021 A1* 5/2007 Brown et al. ..... 166/250.1
2008/0219096 A1* 9/2008 Underhill et al. ..... 367/57

* cited by examiner

*Primary Examiner* — Shane Bomar
*Assistant Examiner* — Catherine Loikith
(74) *Attorney, Agent, or Firm* — Jianguang Du; Jody DeStefanis

(57) ABSTRACT

Subterranean oilfield high-temperature devices configured or designed to operate at elevated temperatures downhole in a well traversing a formation. A tool conveyance is configured for deployment in the well with a downhole cartridge comprising high-temperature sensitive components. A downhole cooling system includes a cooling fluid conduit having a first end configured for fluid connection with a source of cooling fluid and a second end configured for discharging cooling fluid in the well at at least an upper portion of a subterranean high-temperature zone such that cooling fluid circulates in the high-temperature zone.

16 Claims, 8 Drawing Sheets

METHODS AND SYSTEMS FOR DOWNHOLE ACTIVE COOLING

BACKGROUND

The present disclosure relates generally to downhole systems and methods for active cooling of equipment that is deployed in boreholes traversing subterranean formations. More particularly, the present disclosure relates to techniques for circulating cooling fluids in a borehole to provide significant reduction in downhole temperatures.

Logging and monitoring boreholes has been done for many years to enhance and observe recovery of oil and gas deposits. In the logging of boreholes, one method of making measurements underground includes attaching one or more tools to a wireline connected to a surface system. The tools are then lowered into a borehole by the wireline and drawn back to the surface ("logged") through the borehole while taking measurements. Similarly, permanent monitoring systems are established with permanent sensors that are also generally attached to an electrical cable.

The complexity of petro-physical and seismic logging jobs is increasing with time as demands for longer exposures and higher temperatures are placed on the downhole equipment. Even in the case of more robust and reliable technology for downhole circuitry such as analog and/or electronic, there is a need for lowering the temperatures in boreholes so that any type of circuitry can survive downhole for longer periods of time during semi-permanent deployments or in long logging surveys. In high temperature conditions and long exposure logging conditions, both the cost of maintenance and part replacement become very high and labor intensive regardless of the technology that is employed in the downhole circuitry.

In addition, while the cooling of equipment downhole is desirable, many tools in current use would have to be completely reworked or replaced to incorporate new cooling technologies. Furthermore, typically downhole tools are rated or designed for specific operating temperature ranges. It would be desirable to facilitate active cooling with minimal changes to existing tools and equipment. It would also be desirable to use existing tools and equipment at operating temperatures that exceed the design specifications without damaging or extensively modifying the tools or equipment.

The limitations of conventional designs noted in the preceding are not intended to be exhaustive but rather are among many which may reduce the effectiveness of previously known downhole mechanisms.

SUMMARY OF THE DISCLOSURE

The present disclosure addresses the above-described deficiencies and others. Specifically, the present disclosure provides methods and systems for circulating cooling fluids in subterranean formations so that selected zones are cooled to prevent adverse high-temperature effects on tools that are deployed in the formations. In this, the techniques of the present disclosure facilitate the use of existing tools and equipment in expanded temperature ranges without modification or damage to the tools and equipment. The techniques provided herein may be used selectively or may be configured as desirable or necessary depending upon the specific operating environment and requirements of the job.

In certain embodiments, the present disclosure proposes efficient and reliable methods and systems for lowering the borehole temperature, as opposed to actively cooling downhole equipment. By means of circulating fluids in the borehole, a significant reduction of the downhole temperature can be achieved. For example, the present disclosure contemplates reduction in downhole temperatures in excess of about 10 degrees Fahrenheit, and in certain circumstances in excess of about 20 degrees Fahrenheit. Such reductions in downhole temperatures provide the improvements and benefits that are discussed in more detail in the present disclosure. In this, the methods and systems disclosed herein provide cooling of downhole equipment in high-temperature applications.

The present disclosure also contemplates combinations of passive cooling, for example, Peltier coolers, and active cooling of the borehole environment so as to cool downhole tools and equipment. In this, typically conventional cooling devices, such as Peltier coolers, are less effective at higher temperatures, for example, in excess of about 180 degrees Celsius. The techniques herein provide cooler operating environments for conventional downhole cooling devices so that such devices are more effective. As discussed herein, the principles of the present disclosure provide significant flexibility and novel improvements in the cooling of downhole tools and equipment.

In certain embodiments herein, depending on the logging service, circulation of fluids may be continuous, for example, in petro-physical logging, or circulation of fluids may be provided during non-operating times, for example, in seismic surveys. For seismic surveys, filtering techniques may be used to remove noise during the actual survey while circulating fluids in the borehole.

Aspects of the present disclosure provide methods for creating homogeneous temperature environments in a borehole so that downhole measurements, such as acoustic measurements, may be taken at the same ambient temperature. Various cooling fluids and materials, such as nitrogen, water, heat retardant gel, are contemplated by the present disclosure according to the principles discussed herein. In this, the cooling fluid(s) may be selected based on the nature of the job, for example, the type of logging operation to be undertaken. For example, nitrogen may be used as a cooling fluid except in circumstances, such as acoustic logging, where the bubbles might generate noise in the measurements.

In one embodiment of the present disclosure, a subterranean tool is configured to operate at elevated temperatures downhole in a well traversing a formation. The subterranean tool comprises a tool conveyance configured for deployment in the well and a downhole tool comprising high-temperature sensitive components attached to the tool conveyance. A downhole cooling system is provided comprising a cooling fluid conduit having a first end configured for fluid connection with a source of cooling fluid and a second end configured for discharging cooling fluid in the region of the well. The cooling fluid conduit is structured or arranged to discharge cooling fluid at at least an upper portion of a subterranean high-temperature zone such that cooling fluid circulates in the high-temperature zone. The source of the cooling fluid may be located downhole or may be at the surface.

In some aspects herein, the tool conveyance may be a wireline conveyance, and the cooling fluid conduit comprises coiled tubing attached to the tool conveyance. In other aspects of the present disclosure, the tool conveyance comprises coiled tubing and the cooling fluid conduit is the annulus of the coiled tubing. In yet other aspects, the well traversing a formation comprises a horizontal wellbore, and the cooling fluid conduit comprises coiled tubing at an upper portion of the wellbore and the annulus of the wellbore at a lower portion of the wellbore. The coiled tubing may be configured to discharge cooling fluid at an upper portion of the wellbore so as to circulate cooling fluid in the horizontal wellbore.

In some embodiments of the present disclosure, the first end of the cooling fluid conduit is configured for fluid connection with a surface source of cooling fluid. In other embodiments herein, the downhole tool comprises a sensor cartridge configured for sensing subterranean parameters of interest. In further embodiments, the downhole tool comprises a telemetry cartridge configured for communicating data downhole. In yet other embodiments of the present disclosure, the downhole tool comprises fiber optic cable having an associated cooling fluid conduit that is structured and arranged to cool the ambient environment surrounding the fiber optic cable. In certain embodiments herein, the downhole tool comprises a plurality of cartridges or shuttles.

In some aspects of the present disclosure, the subterranean tool may be configured or designed as a seismic imaging tool, a wireline logging tool, a hydro-fracture monitoring tool and/or a permanent monitoring tool. In other aspects, the downhole cooling system may comprise a downhole pump configured for circulating cooling fluid in the subterranean high-temperature zone.

In yet other aspects herein, the subterranean tool may comprise an inverted Y tubular junction having an upper end in connection with an upper portion of the tool conveyance extending from the surface of the well; a first lower end in connection with a lower portion of the tool conveyance extending downhole into the well, the lower portion of the tool conveyance comprising a plurality of tool cartridges or shuttles for deployment in the well; a second lower end in connection with the cooling fluid conduit structured or arranged to discharge cooling fluid at at least an upper portion of a subterranean high-temperature zone, the cooling fluid conduit being attached to the lower portion of the tool conveyance; and a plug in the inverted Y tubular junction such that cooling fluid flowing through the upper portion of the tool conveyance flows into the cooling fluid conduit and does not flow into the lower portion of the tool conveyance. The lower portion of the tool conveyance may comprise a hepta cable configured for interconnecting the plurality of tool cartridges or shuttles for deployment in the well; and the cooling fluid conduit may comprise coiled tubing configured to discharge cooling fluid at at least an upper portion of a subterranean high-temperature zone.

Aspects of the present disclosure include a subterranean cooling system configured to circulate cooling fluid downhole in a well traversing a formation. The system includes a tool conveyance configured for deployment in the well; a downhole tool comprising high-temperature sensitive components attached to the tool conveyance; and a downhole cooling system comprising a cooling fluid conduit having a first end configured for fluid connection with a source of cooling fluid and a second end configured for discharging cooling fluid in the well, wherein the cooling fluid conduit is structured or arranged to discharge cooling fluid at at least an upper portion of a subterranean high-temperature zone such that cooling fluid circulates in the high-temperature zone.

A method of cooling a high-temperature borehole environment is provided. The high-temperature borehole environment having a downhole tool comprising high-temperature sensitive components and configured or designed for sensing subterranean parameters of interest. The method comprising deploying the downhole tool in the high-temperature borehole environment with a tool conveyance; and deploying a cooling fluid conduit having a first end configured for fluid connection with a source of cooling fluid and a second end configured for discharging cooling fluid in a region adjacent the downhole tool, wherein the cooling fluid conduit is structured or arranged to discharge cooling fluid at at least an upper portion of a borehole high-temperature zone such that cooling fluid circulates in the high-temperature zone.

Additional advantages and novel features will be set forth in the description which follows or may be learned by those skilled in the art through reading the materials herein or practicing the principles described herein. Some of the advantages described herein may be achieved through the means recited in the attached claims.

THE DRAWINGS

The accompanying drawings illustrate certain embodiments and are a part of the specification. Together with the following description, the drawings demonstrate and explain some of the principles of the present invention.

Figure 1:
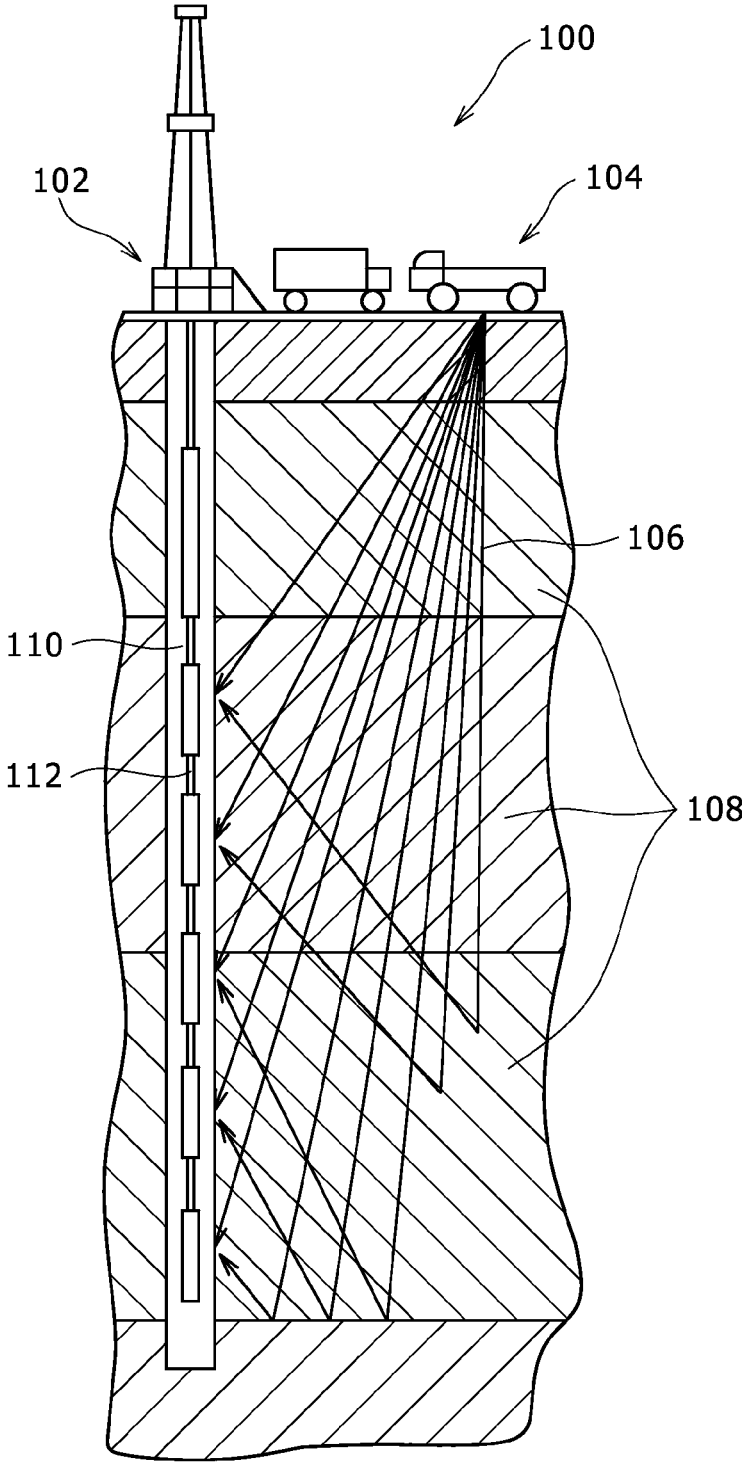
FIG. 1 is a schematic representation of a typical well site with a borehole traversing subsurface formations.

Throughout the drawings, identical reference numbers and descriptions indicate similar, but not necessarily identical elements. While the principles described herein are susceptible to various modifications and alternative forms, specific embodiments have been shown by way of example in the drawings and will be described in detail herein. However, it should be understood that the invention is not intended to be limited to the particular forms disclosed. Rather, the invention includes all modifications, equivalents and alternatives falling within the scope of the appended claims.

DETAILED DESCRIPTION

Illustrative embodiments and aspects of the invention are described below. It will of course be appreciated that in the development of any such actual embodiment, numerous implementation-specific decisions must be made to achieve the developers' specific goals, such as compliance with system-related and business-related constraints, that will vary from one implementation to another. Moreover, it will be appreciated that such development effort might be complex and time-consuming, but would nevertheless be a routine undertaking for those of ordinary skill in the art having the benefit of this disclosure.

Reference throughout the specification to "one embodiment," "an embodiment," "some embodiments," "one aspect," "an aspect," or "some aspects" means that a particular feature, structure, method, or characteristic described in connection with the embodiment or aspect is included in at least one embodiment of the present invention. Thus, the appearance of the phrases "in one embodiment" or "in an embodiment" or "in some embodiments" in various places throughout the specification are not necessarily all referring to the same embodiment. Furthermore, the particular features, structures, methods, or characteristics may be combined in any suitable manner in one or more embodiments. The words "including" and "having" shall have the same meaning as the word "comprising."

Moreover, inventive aspects lie in less than all features of a single disclosed embodiment. Thus, the claims following the Detailed Description are hereby expressly incorporated into this Detailed Description, with each claim standing on its own as a separate embodiment of this invention.

As used throughout the specification and claims, the term "downhole" refers to a subterranean environment, particularly in a wellbore, such as in the field of oilfield exploration and development, management of oil and water reservoirs, sequestration of substances such as $CO_2$, and geothermal applications. "Downhole tool" is used broadly to mean any tool used in a subterranean environment including, but not limited to, a logging tool, an imaging tool, an acoustic tool, a permanent monitoring tool, and a combination tool. "High-temperature" refers to downhole temperatures in excess of about 115 degrees Celsius.

As is generally known, conventional downhole electronic devices are typically configured or designed to operate at about 85 degrees Celsius. Such conventional devices are not suited for efficient operation, and in some cases are unable to operate, at elevated temperatures, i.e., above 85 degrees Celsius, for example, at temperatures in excess of about 115 degrees Celsius. In this, the inherent low temperature operating range (85 degrees Celsius or less) of known downhole devices restricts the use of these devices in high-temperature downhole applications that require components to operate at temperatures in excess of, for example, 115 degrees Celsius and, in some cases, in excess of 150 degrees Celsius.

Typically, in high temperature operations a cooling device, such as a thermo electric cooler (TEC), is needed for the electronics to operate. A cooling device requires additional components for temperature control and power. Additional complexity in the tool architecture reduces reliability. Active borehole cooling systems of the type disclosed herein simplify tool design and improve the reliability of the downhole tools by eliminating in most instances the need for cooling of the downhole devices in high-temperature applications.

The present disclosure provides some embodiments directed towards improving, or at least reducing, the effects of one or more of the above-identified problems and others that are known in the art. In one of many possible embodiments, the present disclosure proposes efficient and reliable methods and systems for lowering the borehole temperature, as opposed to actively cooling downhole equipment. By means of circulating fluids in the borehole, a significant reduction of the downhole temperature can be achieved. In this, the methods and systems disclosed herein provide active cooling of downhole equipment in high-temperature applications.

In certain embodiments herein, depending on the logging service, circulation of fluids may be continuous, for example, in petro-physical logging, or circulation of fluids may be provided during non-operating times, for example, in seismic surveys. For seismic surveys, filtering techniques may be used to remove noise during the actual survey while circulating fluids in the borehole.

Referring to FIG. 1, a schematic depiction of a well site is shown with a diagrammatic representation of a cross section of the subsurface formations traversed by a borehole. The subterranean system 100 includes well instrumentation 102 at the surface including all associated instrumentation and monitoring systems. Also shown at the surface is a surface source 104 which is depicted as a vibration vehicle. The plurality of lines 106 are intended to represent excitations or seismic vibrations traveling through the subsurface formations producing seismic data that can be sensed by downhole sensor arrays. The present systems and methods can be utilized to record seismic data for conducting a seismic survey of the subsurface formations 108. Aspects herein can also be utilized to control and monitor operations during production by monitoring seismic data from the various subsurface formations, regions, and zones. In the monitoring capacity, the disclosure herein can be utilized to optimize production of the well. The placement of the well bore 110 can be strategically located based on known seismic survey data that may have been previously obtained. Optimal placement of the well bore is desired such that optimal recording of seismic data for the subsurface formations of interest can be obtained.

Once the wellbore has been established, a wireline (cable line) 112, a coiled tubing or other conveyance can be spooled to extend down through the well bore where the plurality of sensor arrays are positioned along the wireline 112. Also, note that the wireline with the seismic sensors attached thereto can be extended as the well bore is being established. The principles described herein can be either permanently deployed for continuous production well monitoring or can be temporarily deployed for performing a subsurface seismic survey and then retracted. Permanent deployments enable continuous monitoring of production well operations. Once the wireline and the plurality of sensor arrays are in position, seismic data can begin to be gathered. If production ceases at the well or for some other reason seismic monitoring is no longer required, the system can be retracted and reutilized elsewhere. Note that the exemplary systems presented herein to describe embodiments are for the purpose of illustration and ease of understanding the apparatus and methods. The illustrations shown and described herein should not be construed to be limiting in any way with respect to the scope of the claims.

The principles of the present disclosure may be applied to various applications including, but not limited to, hydro-fracture monitoring, downhole fluids analysis, permanent deployment of tools and equipment in high-temperature environments, coring operations, acoustic, i.e., seismic, sonic, ultrasonic, accelerometer, sensing systems, and semi-permanent or permanent seismic operations that exceed, for example, 5 days. The principles herein may be applied to seismic surveying systems having seismic array tools. In this, in the area of borehole logging, the number of transmitters and receivers and the distance between transmitters and receivers has been increasing to improve the ability to detect formation characteristics in the undisturbed formation farther from the borehole. One method to get deeper penetration is to increase the distance between source and receivers, such that the receivers are detecting signals that are returned from further distances in the borehole. In consequence, the electronics and sensors in the arrays are affected differently based on different ambient temperatures. The techniques disclosed herein provide homogeneous temperature areas for all the sensing arrays so that possible adverse effects due to temperature variations are eliminated, i.e., the same temperature environment is provided across sensor arrays in a borehole.

Figure 2:
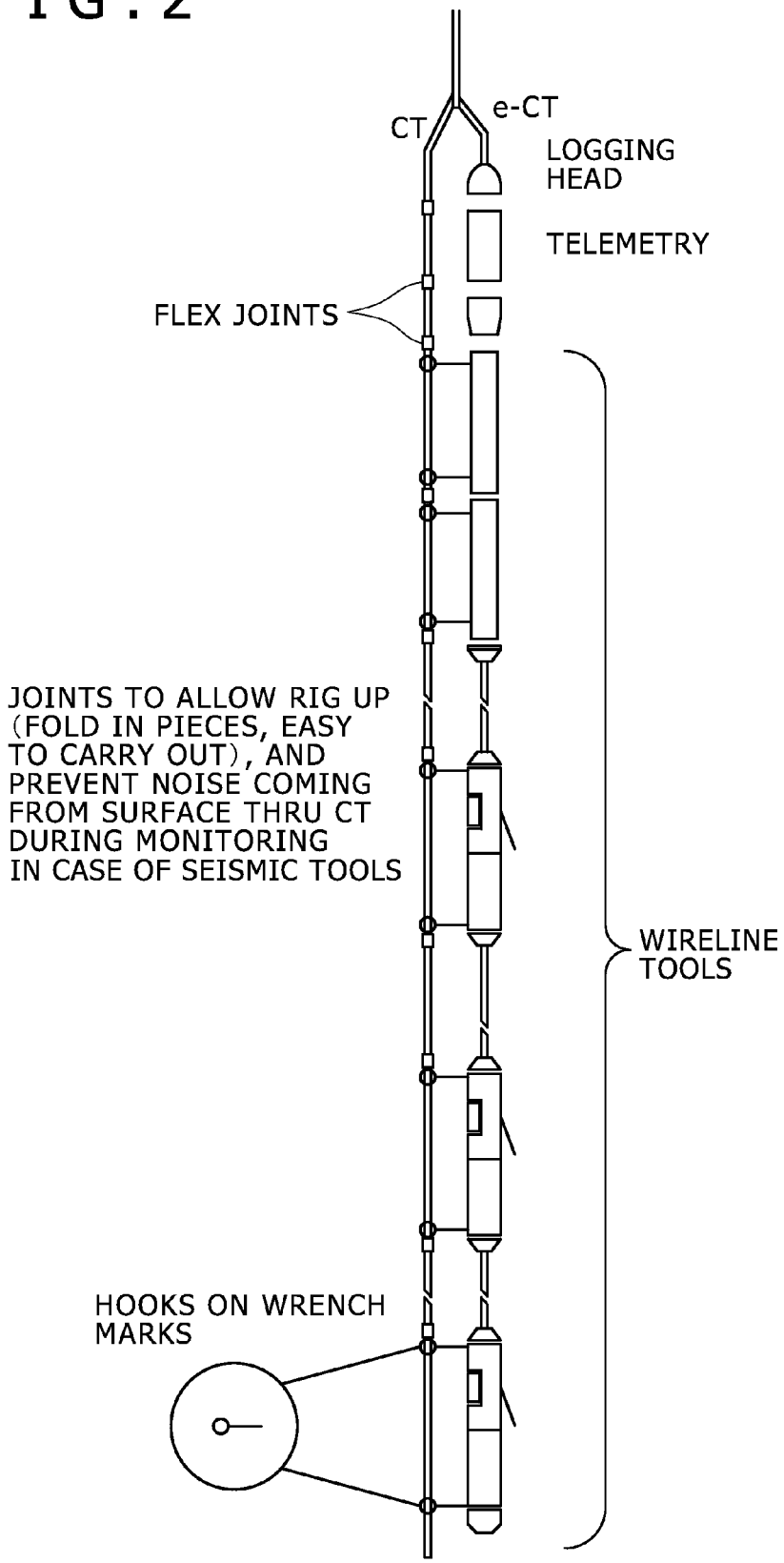
FIG. 2 is a schematic representation of one possible active cooling system for use with an array seismic tool according to the principles of the present disclosure.

Referring to FIG. 2, one possible configuration of a long array seismic tool is disclosed according to the principles of the present disclosure. As disclosed in FIG. 2, a tool conveyance CT is provided for deployment of a downhole tool string in a borehole having a high-temperature region. An inverted Y tubular junction or joint is provided at the upper part of the conveyance CT to interconnect the upper part of the tool conveyance with a cooling fluid conduit (left side) and a conveyance (right side) having a plurality of cartridges or shuttles. A suitable plug element (not shown) is provided in the inverted Y tubular junction so that cooling fluid flows into the cooling fluid conduit (left side), but does not flow into the tool conveyance (right side). The tool conveyance may be, for example, coiled tubing e-CT with electrical cables enclosed in an outer casing. As one possibility the electrical conveyance interconnecting the cartridges or shuttles may be a hepta cable. As schematically depicted in FIG. 2, the cooling fluid conduit may be attached to the tool conveyance by suitable attachment hooks that are attached to, for example, wrench marks. Note also FIG. 3B. The cooling fluid conduit may include flexible joints that facilitate rig up and prevent noise from the surface passing through the tubing during data acquisition and monitoring.

Figure 3A:
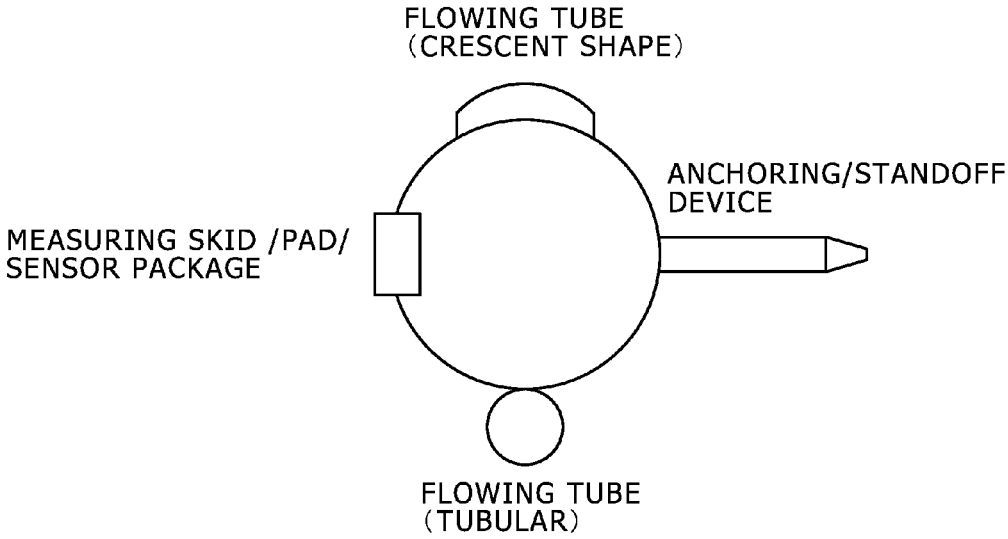
FIGS. 3A and 3B are schematic depictions of some possible mechanisms for deploying an active cooling system according to the present disclosure.
Figure 3B:
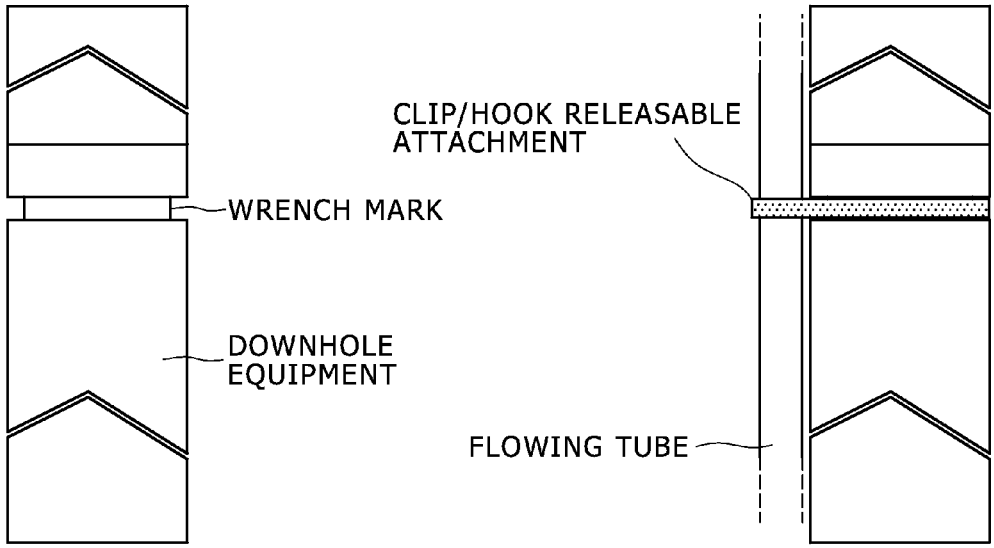

The cooling fluid conduit may be a coiled tubing (CT) conduit. In one possible arrangement, the CT may be placed at an angle of 90 degrees relative to the sensor package/caliper, as shown in FIG. 3A. The CT may be crescent shaped and/or have a conventional tubular shape. Note again FIG. 3A. As shown in FIG. 2, flexible joints may be provided in the CT cooling fluid conduit as desirable or necessary. In this, flexible joints provide easy rig up by folding the CT for convenient transportation, and function as acoustic isolators to prevent surface noise propagating through the CT during monitoring.

The present disclosure contemplates selectively deploying the cooling fluid conduit in high-temperature zones that need to be cooled. For example, the cooling fluid conduit may be run only below the most sensitive parts of the tools that need to be cooled down, for example, the telemetry cartridge and/or sensor shuttles.

The cooling fluid conduit may be attached to the tool string conveyance using suitable attachment mechanisms. For example, the present disclosure contemplates that releasable attachment mechanism, such as rings and/or hooks, may be attached to the wrench marks on the housings of the cartridges to attach the cooling fluid conduit to the tool string conveyance, as shown in the figure on the right in FIG. 3B.

The present disclosure also contemplates various techniques to achieve downhole cooling. For example, as described above, cooling fluids may be injected into the formations from the surface and/or downhole by means of coiled tubing, tubing, drill pipe, etc. to achieve cooling of the wellbore. In this, any suitable mechanisms for pumping cooling fluids may be utilized, in combination with, for example, perforations or any other suitable techniques for the cooling fluids to flow down past the tool(s) and/or other downhole equipment, so that the cooling fluids go into the formations, i.e., a hydro-fracture type of operation.

During rig up/down heavy fluids are pumped so that tools may be deployed/retrieved safely, i.e., so that there is no pressure in the wellbore since there is pressure coming into the well from the perforations, and similar inlets. In this, the present disclosure contemplates that heavy fluids may be sucked or pushed down at the time that fluid circulation and cooling off of the downhole tools is needed. Next, for example, heavy slug and/or gel, or other similar materials, may be re-injected to prepare for a hydro-fracture monitoring operation, i.e., with microseismic monitoring, preventing well flow from perforations, etc., and data acquisition. The techniques and process may be repeated as desirable or necessary.

Figure 4:
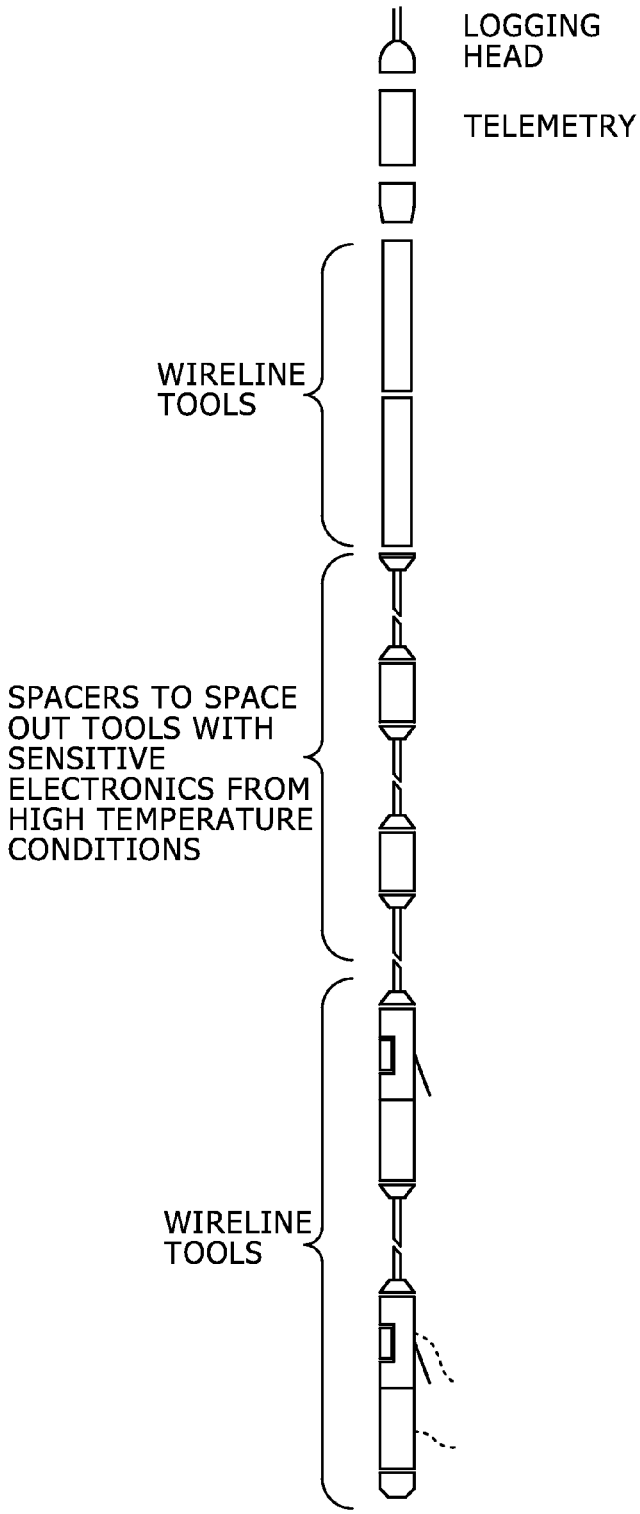
FIG. 4 is a schematic depiction of another possible configuration of an array seismic tool according to the principles of the present disclosure.

FIG. 4 shows an embodiment of the present disclosure in which the distance between the lower terminal tools and sensitive electronics, such as telemetry cartridges and controller cartridges, is increased by placing spacers. For example, thru-wired adapters and/or repeaters may be utilized in the case of seismic imaging tools or similar downhole equipment. As previously mentioned, flexible joints may be provided in the CT that is used for flowing cooling fluid into the borehole along the downhole tools so that the CT can be "folded" for ease of transportation and rig up.

The present disclosure contemplates using the cooling techniques for cooling downhole equipment and/or services where high-telemetry is required. These services may require the use of telemetry cables having fiber optic cables. However, fiber optic is highly sensitive to high temperatures. A reduction in the borehole temperature of the logging cable environment may be achieved using the present techniques without any additional setup for the downhole equipment.

The present disclosure also contemplates utilizing CT flowing conduits as an alternative conveyance of non-rigid downhole equipment, such as array seismic tools, when the downhole equipment are spaced using cables. The downhole equipment may be pushed using the CT and/or, in another possible arrangement, be combined with either wireline or CT tractors to improve the lateral reach of the downhole equipment.

The present disclosure further contemplates utilizing the cooling techniques for purposes of borehole logging in extreme conditions, for example, where borehole temperatures are in excess of about 200 degrees Celsius. Such extreme logging conditions especially require suitable technology for the high-temperature sensitive components to withstand the extremely high temperatures. Typically, analog tools are used in such high-temperature environments; however, cooling the wellbore during surveying and/or monitoring operations utilizing the present cooling techniques would provide increased safety margins in the operations. In this, the present applicant recognized that relatively small reductions in high-temperature borehole environments, for example, temperature reductions of 10 degrees Fahrenheit or more, would provide exceptional results and benefits in terms of tool deployment and operation. Moreover, the techniques disclosed herein are designed such that cooling may be selectively applied by switching on/off the cooling fluids as desirable or necessary.

Figure 5:
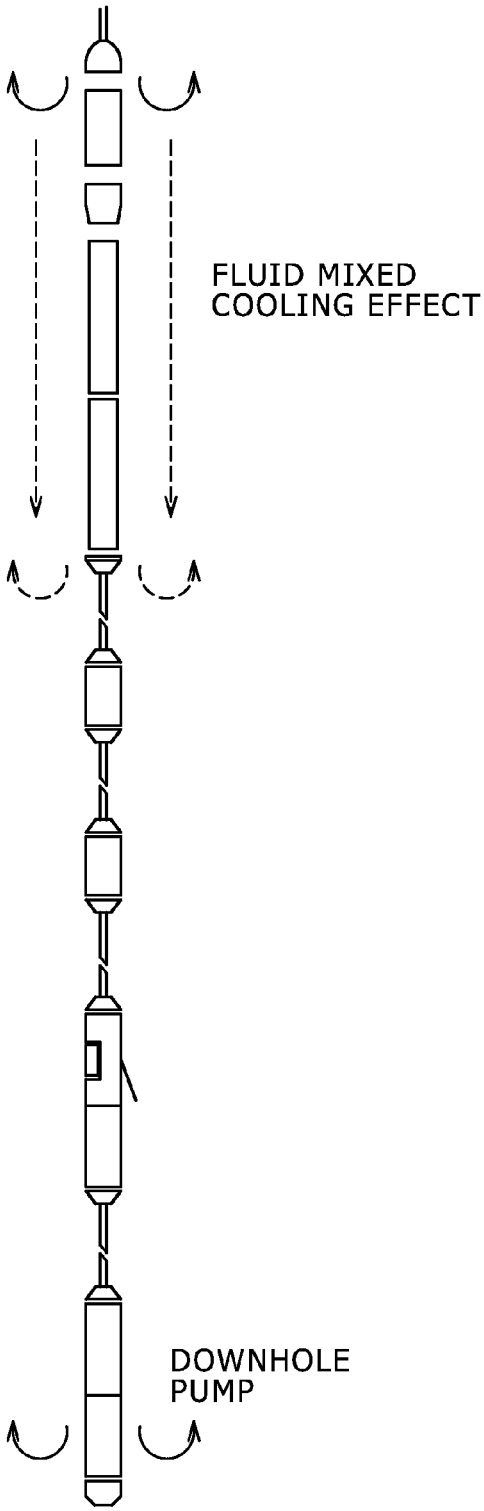
FIG. 5 is a schematic representation of yet another possible embodiment of an active cooling system according to the principles of the present disclosure.

In other possible embodiments of the present techniques, long downhole equipment may be cooled by selectively discharging cooling fluid in the borehole. For example, instead of cooling down the entire tool string it is contemplated that by combining a CT cooling fluid conduit at the top section of the tool, i.e., typically at the logging head, with a downhole pump, that is located at the bottom of the tool string, adequate cooling may be provided for the heat sensitive parts of the long downhole tool. The downhole pump may be configured to provide cooling fluid flow and circulation from the CT section and below. An exemplary configuration for a cooling fluid conduit and downhole pump combination is illustrated in FIG. 5.

Figure 6:
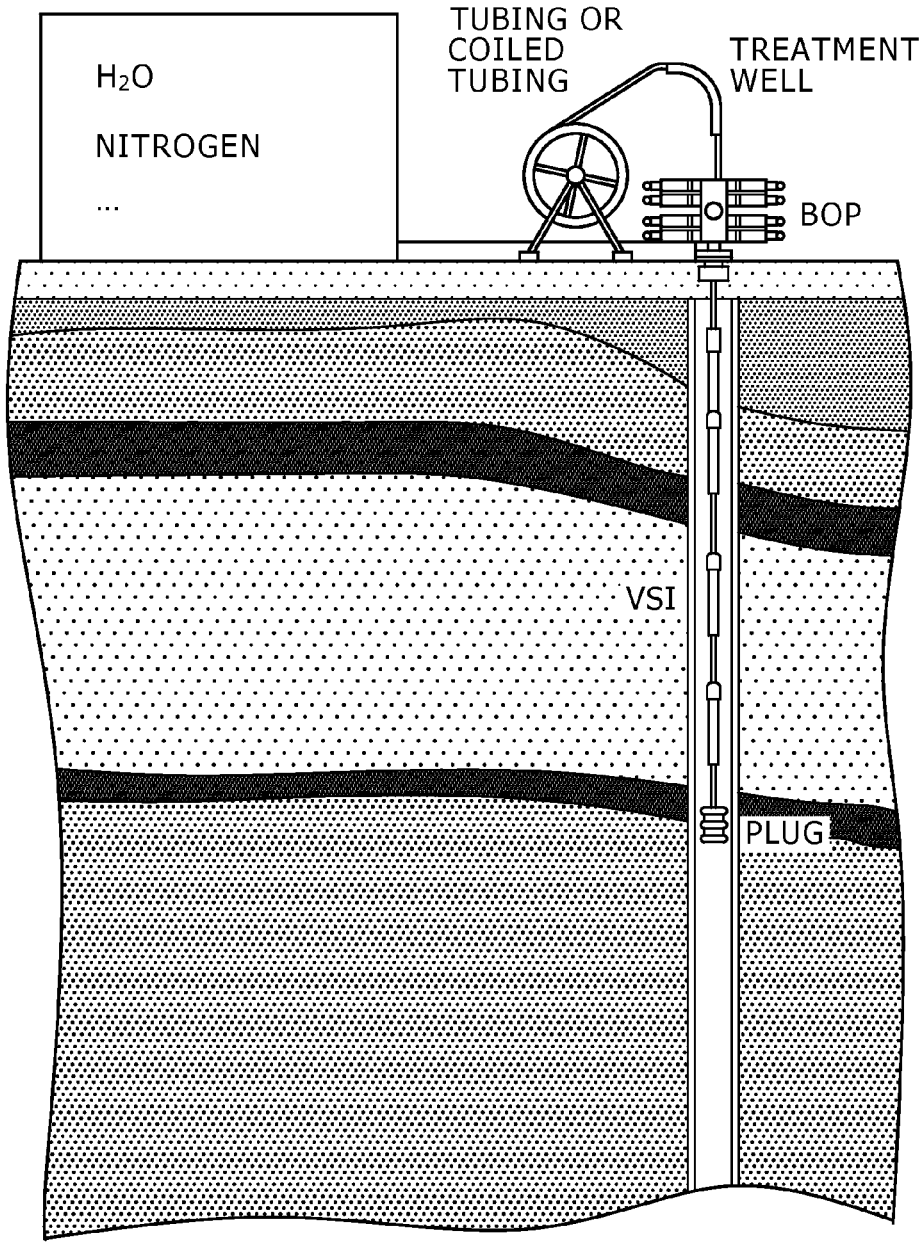
FIG. 6 depicts one exemplary borehole cooling system according to the principles of the present disclosure.

FIG. 6 illustrates an exemplary surface setup according to the principles of the present disclosure. For example, coiled tubing (CT), or other alternative equivalent apparatus such as drill pipe, may be setup as in conventional wellsite operations with storage tanks having the cooling fluids at the surface. Cooling fluids that are contemplated by the present disclosure include water, nitrogen, heat-retardant fluids, among others that are known to those skilled in the art for the purposes of the present disclosure. For example, the cooling fluids may be at ambient temperature, or any suitable active cooling method may be employed to cool the fluids as desirable or necessary.

In this, the present disclosure contemplates any effective method for cooling the fluids, such as passing the fluids through a container that is exposed to ambient temperature, or has active cooling mechanisms associated therewith.

Figure 7A:
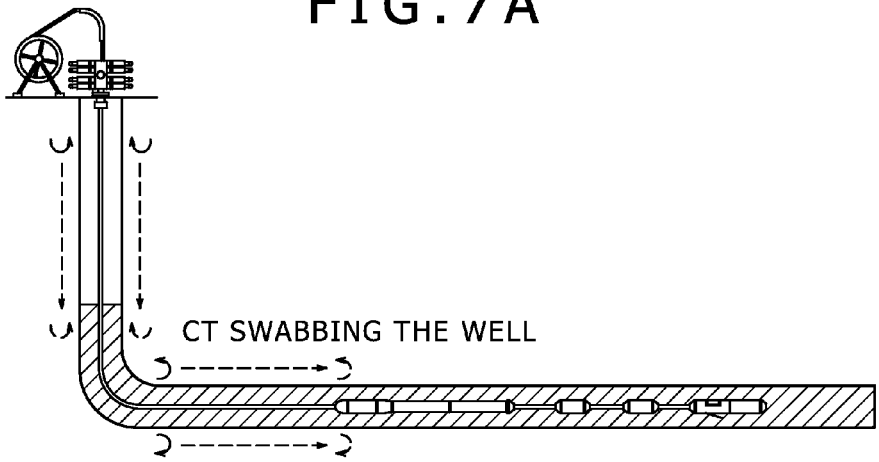
FIGS. 7A-7C depict other exemplary borehole cooling systems according to the principles of the present disclosure.
Figure 7B:
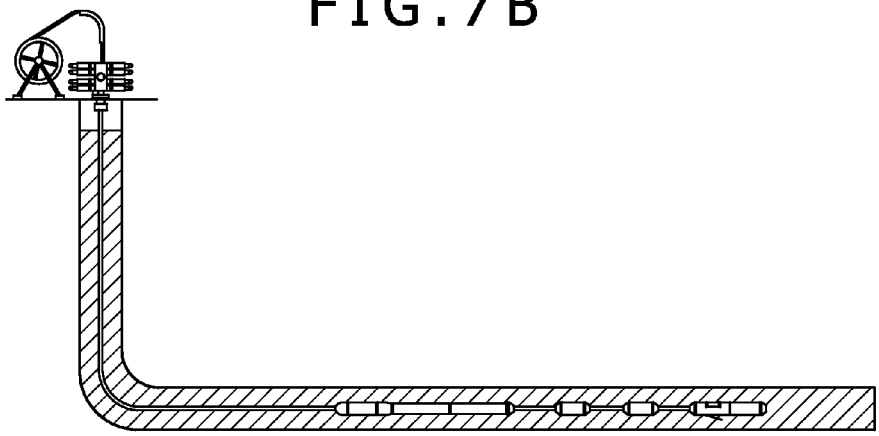
Figure 7C:
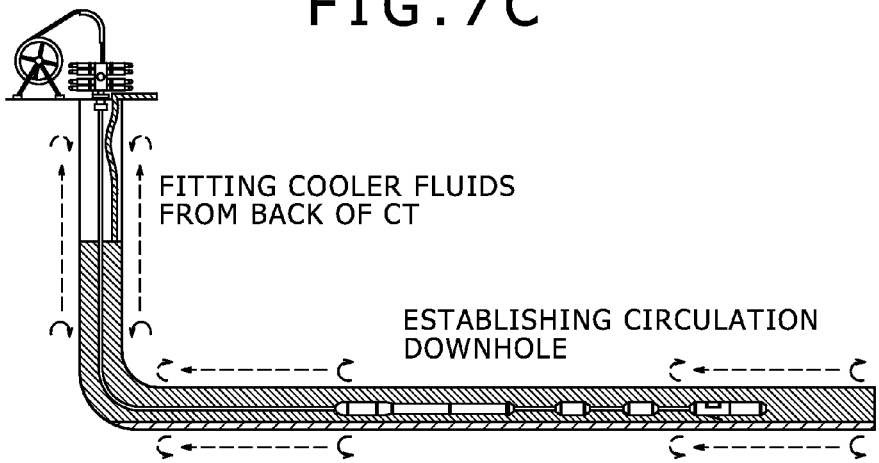

FIGS. 7A-7C disclose some possible arrangements for cooling wells having horizontal wellbores. As one possible embodiment, in horizontal deployments of downhole tools cooling fluid may be provided downhole by combining swabbing of the well using CT with replenishment of the swabbed borehole fluids with cooler fluids that are pumped from the surface. It is possible to continue the cooling operation for as long as it is necessary to keep the downhole tools deployed in the well. It is contemplated that thermometers or DT sensors may be located along the downhole tools to provide temperature feedback, and the temperature information may be transmitted uphole in real-time so that the cooling fluid circulation process can be effectively and efficiently controlled as desirable or necessary. In this, the present techniques provide simple and efficient downhole cooling systems that do not require special downhole equipment for the downhole cooling process. It is also contemplated that the downhole cooling process of completely swabbing and then replenishing the well with cooling fluids may be replaced by establishing a circulation pattern once the level of the fluids in the horizontal portion of the wellbore is lowered and by simultaneously pumping cooling fluids. In the case of acoustic logging, for example, by performing the circulation with very low pumping rates, such as less than 20 barrels per minute, active cooling of the borehole environment may be provided during the operating time, i.e., during the active measurement of acoustic signals, so that no significant noise is introduced. It is further envisioned that any noise that might be introduced during the monitoring operations could be removed with suitable filtering techniques that are known in the art.

The present disclosure contemplates utilizing the present techniques in combination with alternative conveyance means such as through-drill-pipe. It is also envisioned that the present techniques may be used in combination with various Schlumberger tools such as the Through-Tubing Well Seismic Tool and Wired Drill Pipe imaging tools, and downhole fluids analysis tools such as the MDT. In this, through-drill-pipe and/or through-tubing techniques would provide safe and effective deployment of semi-permanent tools in most open hole conditions.

Some of the above-described methods and apparatus have applicability for both performing borehole surveys for planning wellbore drilling and production and for monitoring borehole data during actual well production. Such borehole surveys include borehole seismic surveys and such monitoring of borehole data includes temporary or permanent monitoring. Fiber optic technology has the ability to multiplex multiple channels at a high data rate, thereby satisfying the demand for acoustic and seismic imaging applications which require a large sensor array with high data transmission capabilities. Use of fiber optic technology in embodiments herein also allows for a greater number of shuttles because of the smaller profile, lighter weight and the fact that no downhole electronics or power from the surface is required.

Sensors used in the borehole environment demand an ever increasing bandwidth as the demand for higher resolution sensors increases. Copper cables used for logging in the borehole are reaching the limit for the bandwidth they can provide. Fiber optic cables can provide a significantly higher bandwidth for new high resolution sensors. The use of fiber optic cables requires high-temperature sensitive downhole optical devices, and the electronics used to condition sensor signals and to provide telemetry from downhole to uphole.

However, optic transmission systems need controlled temperature downhole conditions to control the temperature effects on downhole equipment. An optic transmission system associated with a borehole may include a downhole cooling system that is located proximate to associated temperature sensitive electronics and components to provide localized cooling of the downhole environment.

Figure 8:
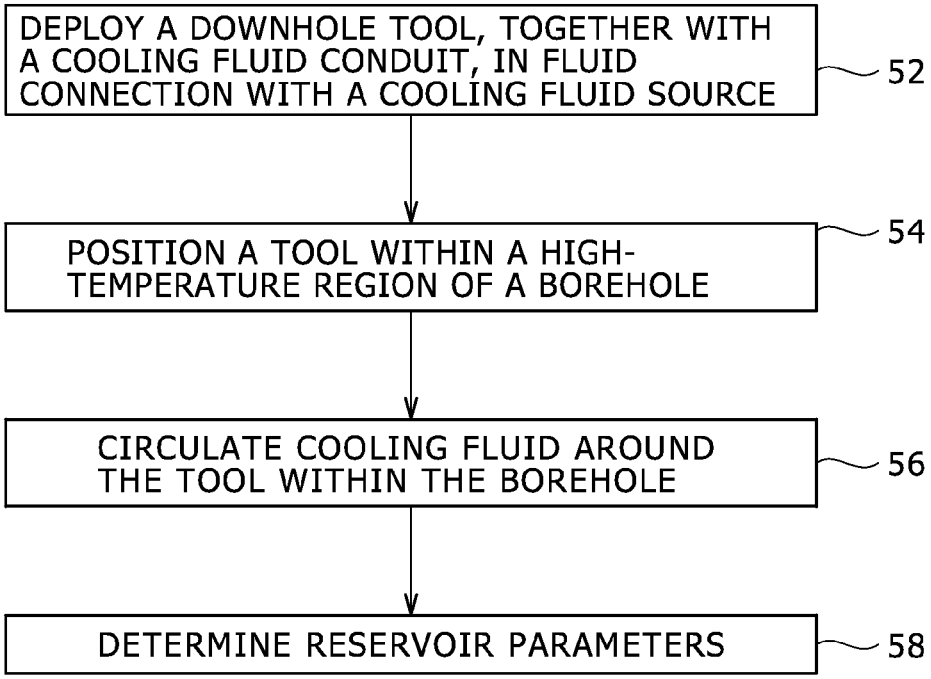
FIG. 8 depicts one exemplary method for cooling a borehole high-temperature environment according to the principles of the present disclosure.

Referring to FIG. 8, a flowchart is provided of one possible embodiment of a method of cooling a downhole high-temperature environment for deployment of high-temperature sensitive downhole tools. The downhole tools may include a plurality of shuttles along a cable line that contains a sensor and clamper package. Other sensors can also be attached along the wireline such as pressure/temperature (P/T) sensors. The wireline can be adapted to carry various communication lines, including fiber optic sensor array communication lines for a fiber optic system. The wireline can also be adapted to carry the hydraulic line or electrical line actuator control for actuation of the clamper. Various monitoring and control systems can be located at the surface such as the actuator control system which can be operable to control actuation of the clamp. The borehole sensor system can monitor, store, and interpret the data output by the sensors. An electrical cartridge may be provided on the conveyance below the sensor section. In further embodiments, the borehole sensors may be seismic sensors.

At 52, a downhole tool, together with a cooling fluid conduit that is in fluid connection with a cooling fluid source, is deployed in a borehole. At 54, the downhole tool is positioned within a high-temp region in the borehole. At 56, the cooling liquid is circulated around the downhole tool. At 58, reservoir parameters are determined using the downhole tool.

The embodiments and aspects were chosen and described in order to best explain the principles of the invention and its practical applications. The preceding description is intended to enable others skilled in the art to best utilize the principles described herein in various embodiments and with various modifications as are suited to the particular use contemplated. It is intended that the scope of the invention be defined by the following claims.

What is claimed is:

1. A subterranean tool configured to operate at elevated temperatures downhole in a well traversing a formation, comprising:

a tool conveyance configured for deployment in the well;

a downhole tool comprising high-temperature sensitive components attached to the tool conveyance; and a downhole cooling system, comprising:

a cooling fluid conduit having a first end configured for fluid connection with a source of cooling fluid and a second end configured for discharging cooling fluid in a region of the downhole tool, wherein the cooling fluid conduit is structured or arranged to discharge cooling fluid at at least an upper portion of a subterranean high-temperature zone such that cooling fluid circulates in the high-temperature zone, the subterranean tool further comprising:

an inverted Y tubular junction, wherein an upper end of the Y tubular junction is configured for connection with an upper portion of the tool conveyance extending from the surface of the well;

a first lower end of the Y tubular junction is configured for connection with a lower portion of the tool conveyance extending downhole into the well, the lower portion of the tool conveyance comprising a plurality of tool cartridges or shuttles for deployment in the well;

a second lower end of the Y tubular junction is configured for connection with the cooling fluid conduit, the cooling fluid conduit being attached to the lower portion of the tool conveyance; and a plug in the inverted Y tubular junction such that cooling fluid flowing through the upper portion of the tool conveyance flows into the cooling fluid conduit and does not flow into the lower portion of the tool conveyance.

2. A subterranean tool according to claim 1, wherein the tool conveyance is a wireline conveyance and the cooling fluid conduit comprises coiled tubing attached to the tool conveyance.

3. A subterranean tool according to claim 1, wherein the tool conveyance comprises coiled tubing and the cooling fluid conduit is the annulus of the coiled tubing.

4. A subterranean tool according to claim 1, wherein the well traversing a formation comprises a horizontal wellbore; and the cooling fluid conduit comprises coiled tubing at an upper portion of the wellbore and the annulus of the wellbore at a lower portion of the wellbore, the coiled tubing being configured to discharge cooling fluid at an upper portion of the wellbore so as to circulate cooling fluid in the horizontal wellbore.

5. A subterranean tool according to claim 1, wherein the first end of the cooling fluid conduit is configured for fluid connection with a surface source of cooling fluid.

6. A subterranean tool according to claim 1, wherein the downhole tool comprises a sensor cartridge configured for sensing subterranean parameters of interest.

7. A subterranean tool according to claim 1, wherein the downhole tool comprises a telemetry cartridge configured for communicating data downhole.

8. A subterranean tool according to claim 1, wherein the downhole tool comprises fiber optic cable.

9. A subterranean tool according to claim 1, wherein the downhole tool comprises a plurality of cartridges or shuttles.

10. A subterranean tool according to claim 1, wherein the downhole tool comprises a seismic imaging tool.

11. A subterranean tool according to claim 1, wherein the subterranean tool is configured for wireline logging.

12. A subterranean tool according to claim 1, wherein the subterranean tool is configured for hydro-fracture monitoring.

13. A subterranean tool according to claim 1, wherein the subterranean tool is configured for permanent monitoring.

14. A subterranean tool according to claim 1, wherein the downhole cooling system further comprises a downhole pump configured for circulating cooling fluid in the subterranean high-temperature zone.

15. A subterranean tool according to claim 1, wherein the lower portion of the tool conveyance comprises a hepta cable configured for interconnecting the plurality of tool cartridges or shuttles for deployment in the well; and the cooling fluid conduit comprises coiled tubing configured to discharge cooling fluid at at least an upper portion of a subterranean high-temperature zone.

16. A method of cooling a high-temperature borehole environment, the method comprising:

deploying a subterranean tool according to claim 1 in the high-temperature borehole environment; and discharging cooling fluid at at least an upper portion of a borehole high-temperature zone such that cooling fluid circulates in the high-temperature zone.

* * * * *